US009589523B2

(12) United States Patent
Xiao

(10) Patent No.: US 9,589,523 B2
(45) Date of Patent: Mar. 7, 2017

(54) GOA CIRCUIT AND LIQUID CRYSTAL DISPLAY

(71) Applicants: Shenzhen China Star Optoelectronics Technology Co., Ltd., Shenzhen, Guangdong (CN); Wuhan China Star Optoelectronics Technology Co., Ltd., Wuhan, Hubei (CN)

(72) Inventor: Juncheng Xiao, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 72 days.

(21) Appl. No.: 14/765,791

(22) PCT Filed: Apr. 30, 2015

(86) PCT No.: PCT/CN2015/078000

§ 371 (c)(1),
(2) Date: Aug. 4, 2015

(87) PCT Pub. No.: WO2016/165162

PCT Pub. Date: Oct. 20, 2016

(65) Prior Publication Data

US 2016/0307535 A1 Oct. 20, 2016

(30) Foreign Application Priority Data

Apr. 17, 2015 (CN) ..... 2015 1 0186029

(51) Int. Cl.

| | |
|---|---|
| ***G09G 5/00*** | (2006.01) |
| ***G09G 3/36*** | (2006.01) |
| ***G09G 3/20*** | (2006.01) |

(52) U.S. Cl.
CPC ..... *G09G 3/3677* (2013.01); *G09G 3/20* (2013.01); *G09G 2310/0251* (2013.01); (Continued)

(58) Field of Classification Search
CPC ..... G09G 3/3677; G09G 3/20; G09G 2310/0267; G09G 2310/0286; (Continued)

(56) References Cited

U.S. PATENT DOCUMENTS

2016/0260403 A1* 9/2016 Dai ..... G09G 3/36

* cited by examiner

*Primary Examiner* — Adam R Giesy
(74) *Attorney, Agent, or Firm* — Andrew C. Cheng

(57) ABSTRACT

A GOA circuit comprising GOA units and a liquid crystal display are disclosed. The N-staged GOA units charge the Nth-staged horizontal scanning line in the display region, and comprise N-staged pull-up control circuits, N-staged pull-up circuits, N-staged transfer circuits, N-staged pull-down circuits, and N-staged pull-down holding circuits. The N-staged pull-up circuits turn on when the Nth-staged gate signal point is at a high voltage level, receive a first clock signal and charge the N-staged horizontal scanning lines when the first clock signal is at a high voltage level. The N-staged transfer circuits receive a second clock signal when the Nth-staged gate signal point is at the high voltage level and output N-staged transfer signals to control the operation of the (N+1)-staged GOA units. The disclosure may ensure the scanning lines in the GOA circuit to be better charged for facilitating normal operation for each point in the circuit.

18 Claims, 8 Drawing Sheets

(52) U.S. Cl.
CPC ..... *G09G 2310/0267* (2013.01); *G09G 2310/0286* (2013.01); *G09G 2310/06* (2013.01); *G09G 2310/08* (2013.01); *G09G 2330/021* (2013.01)

(58) Field of Classification Search
CPC ..... G09G 2330/021; G09G 2310/0251; G09G 2310/06; G09G 2310/08
See application file for complete search history.

GOA CIRCUIT AND LIQUID CRYSTAL DISPLAY

BACKGROUND

Technical Field

The disclosure is related to the technology field for the liquid crystal display, and more particular to a GOA circuit and a liquid crystal display.

Related Art

Among displays with small size and high resolution, it is known to the public that LTPS (Low Temperature Poly-Silicon) technology has been widely adopted due to the high mobility and stability. However, the low yield rate for LTPS displays has greatly perplexed the panel manufactures. In this respect, the array test is a necessary and prompt approach to monitor each manufacturing process.

With the development of LTPS semi-conductor thin film transistors, due to the ultra-high carrier mobility of the LTPS semi-conductor thin film transistors, corresponding peripheral integrated circuits for panels have become the focus of everyone's attention. And a lot of people are devoted into the related technology research for System on Panel (SOP), and it gradually becomes a reality.

Although the LTPS semi-conductor thin film transistors have higher carrier mobility, the threshold voltage is lower (unusually around 0 volt), and the swing of the threshold region is small. In the off state of the GOA circuit, many elements operate close to Vth or higher to Vth. This increases the difficulty on the design of the LTPS GOA circuit. Many scanning-driving circuits applied for amorphous silicon semiconductors may not be applied easily to LTPS TFT-LCD. Some functional problems exist. This would directly result in malfunction on the IGZO GOA circuit. Therefore, the affection caused by such elements on the GOA circuit need to be considered when designing the circuit.

SUMMARY

The technical problem mainly solved by the present disclosure is to provide a GOA circuit and a liquid crystal display to ensure the scanning lines in the GOA circuit to be better charged for facilitating normal operation for each point in the circuit.

In order to solve the above technical problem, one technical solution adopted by the present disclosure is to provide a GOA circuit, A GOA circuit for a liquid crystal display, the GOA circuit comprising a plurality of GOA units, the N-staged GOA units charging the Nth-staged horizontal scanning line in the display region, the N-staged GOA units comprising N-staged pull-up control circuits, N-staged pull-up circuits, N-staged transfer circuits, N-staged pull-down circuits, and N-staged pull-down holding circuits; wherein the N-staged pull-up circuits and the N-staged pull-down holding circuits connect to the Nth-staged gate signal point and the Nth-staged horizontal scanning line respectively, the N-staged pull-up control circuits, the N-staged pull-down circuits, and the N-staged transfer circuits connect to the Nth-staged gate signal point; wherein the N-staged pull-up circuits turn on when the Nth-staged gate signal point is at a high voltage level, receive a first clock signal and charge the N-staged horizontal scanning lines when the first clock signal is at a high voltage level; wherein the N-staged transfer circuits receive a second clock signal when the Nth-staged gate signal point is at the high voltage level and output N-staged control circuits to control the operation of the (N+1)-staged GOA units; wherein the pulse width of the second clock signal is greater than the pulse width of the first clock signal; wherein the N-staged pull-down holding circuits comprise: a first transistor having a gate and a drain connected to a direct current high voltage; a second transistor having a gate connected to the source of the first transistor, a drain connected to the direct current high voltage, and a source connected to a first common point; a third transistor having a gate connected to the Nth-staged gate signal point, a drain connected to the source of the first transistor, and a source connected to the first direct current low voltage; a fourth transistor having a gate connected to the Nth-staged gate signal point and a drain connected to the common point; a fifth transistor having a gate connected to the Nth-staged gate signal point and a drain connected to the common point; a sixth transistor having a gate connected to the source of the fourth transistor, a drain connected to the source of the fifth transistor and a source connected to the third direct current low voltage; a seventh transistor having a gate connected to the source of the fourth transistor, and a source connected to the third direct current low voltage; an eighth transistor having a gate and a drain connected to the direct current high voltage; a ninth transistor having a gate connected to the source of the eighth transistor, a drain connected to the direct current high voltage and a source connected to the source of the fifth transistor; a tenth transistor having a gate connected to the common point, a drain connected to the Nth-staged gate signal point, and a source connected to the second direct current low voltage; and an eleventh transistor having a gate connected to the common point, a drain connected to the Nth-staged horizontal scanning line and a source connected to the second direct current low voltage; wherein the first direct current low voltage is grater than the second direct current low voltage, and the second direct current low voltage is greater than the third direct current low voltage; wherein the N-staged transfer circuits comprise N-staged bootstrap capacitors; wherein the N-staged bootstrap capacitors are connected between the Nth-staged gate signal points and the Nth-staged horizontal scanning line.

In order to solve the above technical problem, another technical solution adopted by the present disclosure is to provide a GOA circuit, the GOA circuit comprising a plurality of GOA units, the N-staged GOA units charging the Nth-staged horizontal scanning line in the display region, the N-staged GOA units comprising N-staged pull-up control circuits, N-staged pull-up circuits, N-staged transfer circuits, N-staged pull-down circuits, and N-staged pull-down holding circuits; wherein the N-staged pull-up circuits and the N-staged pull-down holding circuits connect to the Nth-staged gate signal point and the Nth-staged horizontal scanning line respectively, the N-staged pull-up control circuits, the N-staged pull-down circuits, and the N-staged transfer circuits connect to the Nth-staged gate signal point; wherein the N-staged pull-up circuits turn on when the Nth-staged gate signal point is at a high voltage level, receive a first clock signal and charge the N-staged horizontal scanning lines when the first clock signal is at a high voltage level; wherein the N-staged transfer circuits receive a second clock signal when the Nth-staged gate signal point is at the high voltage level and output N-staged transfer signals to control the operation of the (N+1)-staged GOA units; wherein the pulse width of the second clock signal is greater than the pulse width of the first clock signal.

In one embodiment, the N-staged pull-down holding circuits comprise: a first transistor having a gate and a drain connected to a direct current high voltage; a second transistor having a gate connected to the source of the first transistor, a drain connected to the direct current high voltage, and a source connected to a first common point; a third transistor having a gate connected to the Nth-staged gate signal point, a drain connected to the source of the first transistor, and a source connected to the first direct current low voltage; a fourth transistor having a gate connected to the Nth-staged gate signal point and a drain connected to the common point; a fifth transistor having a gate connected to the Nth-staged gate signal point and a drain connected to the common point; a sixth transistor having a gate connected to the source of the fourth transistor, a drain connected to the source of the fifth transistor and a source connected to the third direct current low voltage; a seventh transistor having a gate connected to the source of the fourth transistor, and a source connected to the third direct current low voltage; an eighth transistor having a gate and a drain connected to the direct current high voltage; a ninth transistor having a gate connected to the source of the eighth transistor, a drain connected to the direct current high voltage and a source connected to the source of the fifth transistor; a tenth transistor having a gate connected to the common point, a drain connected to the Nth-staged gate signal point, and a source connected to the second direct current low voltage; and an eleventh transistor having a gate connected to the common point, a drain connected to the Nth-staged horizontal scanning line and a source connected to the second direct current low voltage; wherein the first direct current low voltage is grater than the second direct current low voltage, and the second direct current low voltage is greater than the third direct current low voltage.

In one embodiment, the N-staged pull-down holding circuits comprises the first transistor, the second transistor, the third transistor, the fourth transistor, the fifth transistor, the sixth transistor, the ninth transistor, the tenth transistor, and the eleventh transistor; wherein the gate of the ninth transistor is connected to the common point.

In one embodiment, the N-staged pull-down holding circuits comprises the first transistor, the second transistor, the third transistor, the fourth transistor, the sixth transistor, the seventh transistor, the eighth transistor, the ninth transistor, the tenth transistor, and the eleventh transistor; wherein the drain of the sixth transistor and the source of the ninth transistor are connected to the source of the fourth transistor, and the gate of the sixth transistor and the gate of the seventh transistor are connected to the Nth-staged gate signal point.

In one embodiment, the N-staged pull-down holding circuits comprises the first transistor, the second transistor, the third transistor, the fourth transistor, the sixth transistor, the ninth transistor, the tenth transistor, and the eleventh transistor; wherein the gate of the ninth transistor is connected to the gate of the second transistor.

In one embodiment, the gate of the ninth transistor is connected to the common point.

In one embodiment, the N-staged transfer circuits comprise N-staged bootstrap capacitors, wherein the N-staged bootstrap capacitors are connected between the Nth-staged gate signal points and the Nth-staged horizontal scanning line.

In one embodiment, the control terminals of the N-staged pull-down circuits are input with a third clock signal; wherein the duty ratio of the first clock signal is less than 50%, and the starting time of the high voltage level of the first clock signal is the same as the starting time of the high voltage level of the second clock signal; wherein the high voltage level of the third clock signal corresponds to the low voltage level of the second clock signal, and the low voltage level of the third clock signal corresponds to the high voltage level of the second clock signal.

In one embodiment, the control terminals of the N-staged pull-down circuits are input with the third clock signal; wherein the duty ratio of the first clock signal is less than 50%, and the ending time of the high voltage level of the first clock signal is the same as the ending time of the high voltage level of the second clock signal; wherein the high voltage level of the third clock signal corresponds to the low voltage level of the second clock signal, and the low voltage level of the third clock signal corresponds to the high voltage level of the second clock signal.

Distinguishing from the current technology, the beneficial effects of the present disclosure is that two clock signals having different pulse widths are input to the N-staged pull-up circuits and the N-staged transfer circuits such that the output signals may be separated from the transfer signals. Therefore, the voltage level of Q(N) point is raised to a better high voltage level. The delay of the output signals is reduced, and the better charge of the scanning lines in the GOA circuit is ensured for facilitating the normal operation for each point in the circuit.

BRIEF DESCRIPTION OF THE DRAWINGS

The above and other exemplary aspects, features and advantages of certain exemplary embodiments of the present disclosure will be more apparent from the following description taken in conjunction with the accompanying drawings, in which.

DETAILED DESCRIPTION

Figure 1:
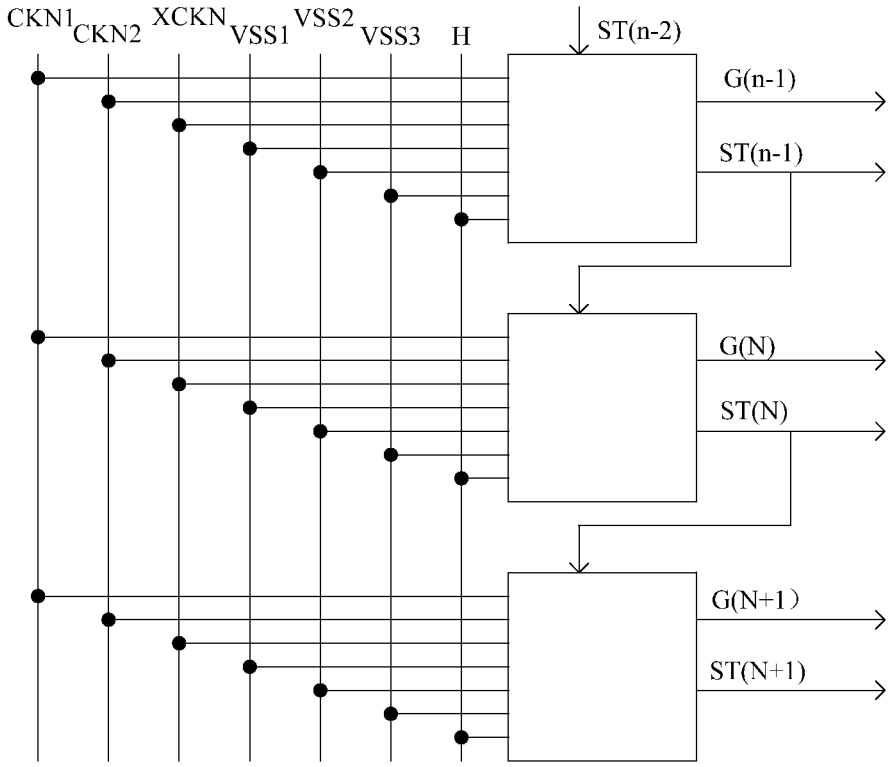
FIG. 1 is the schematic diagram of the cascading GOA units of the first embodiment of the GOA circuit according to the disclosure.

Refer to FIG. 1 for the schematic diagram of the cascading GOA units of the first embodiment of the GOA circuit according to the disclosure. The GOA circuit comprises a plurality of GOA units. The N-staged GOA units charge the Nth-staged horizontal scanning line G(N) in the display region.

Figure 2:
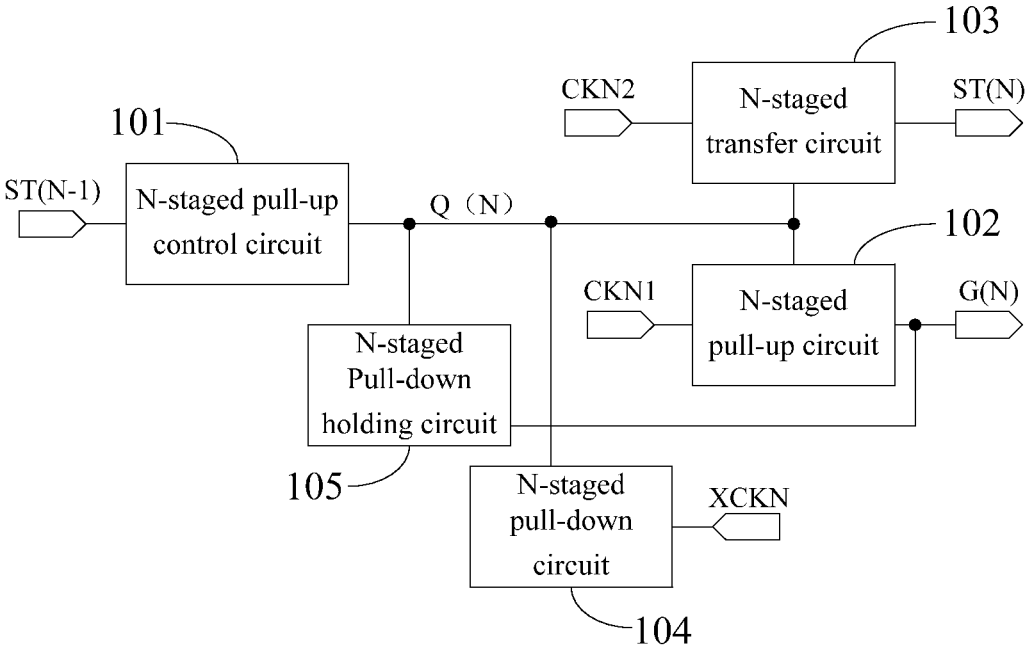
FIG. 2 is the schematic diagram of the GOA unit of the first embodiment of the GOA circuit according to the disclosure.

Refer to FIG. 2 for the schematic diagram of the GOA unit of the first embodiment of the GOA circuit according to the disclosure.

The N-staged GOA units comprise N-staged pull-up control circuits 101, N-staged pull-up circuits 102, N-staged transfer circuits 103, N-staged pull-down circuits 104, and N-staged pull-down holding circuits 105. The N-staged pull-up circuits 102 and the N-staged pull-down holding circuits 105 connect to the Nth-staged gate signal point Q(N) and the Nth-staged horizontal scanning line G(N) respectively. The N-staged pull-up control circuits 101, the N-staged pull-down circuits 104, and the N-staged transfer circuits 103 connect to the Nth-staged gate signal point Q(N).

The N-staged pull-up circuits turn on when the Nth-staged gate signal point Q(N) is at a high voltage level, receive a first clock signal CKN1 and charge the N-staged horizontal scanning lines G(N) when the first clock signal CKN1 is at a high voltage level. The N-staged transfer circuits receive a second clock signal CKN2 when the Nth-staged gate signal point Q(N) is at the high voltage level and output N-staged transfer signals ST(N) to control the operation of the (N+1)-staged GOA units. The pulse width of the second clock signal CKN2 is greater than the pulse width of the first clock signal CKN1.

Specifically, the N-staged pull-up control circuits 101 turn on and raise the voltage level of the Nth-staged gate signal point Q(N) to high voltage level when receiving the ST(N−1) signal of high voltage level in order to turn on the N-staged pull-up circuits 102 an the N-staged transfer circuits 103 such that the N-staged pull-up circuits 102 and the N-staged transfer circuits 13 respectively output the first clock signal CKN1 and the second clock signal CKN2. After the clock signals are output, the N-staged pull-down circuits 104 pull down the voltage level of the Nth-staged gate signal point Q(N) to the low voltage level. The N-staged pull-down holding circuits 103 maintain the voltage level of the Nth-staged gate signal point Q(N) and the Nth-staged horizontal scanning line G(N) at the low voltage level.

Distinguishing from the current technology, two clock signals having different pulse widths are input to the N-staged pull-up circuits and the N-staged transfer circuits such that the output signals may be separated from the transfer signals. Therefore, the voltage level of Q(N) point is raised to a better high voltage level. The delay of the output signals is reduced, and the better charge of the scanning lines in the GOA circuit is ensured for facilitating the normal operation for each point in the circuit.

Figure 3:
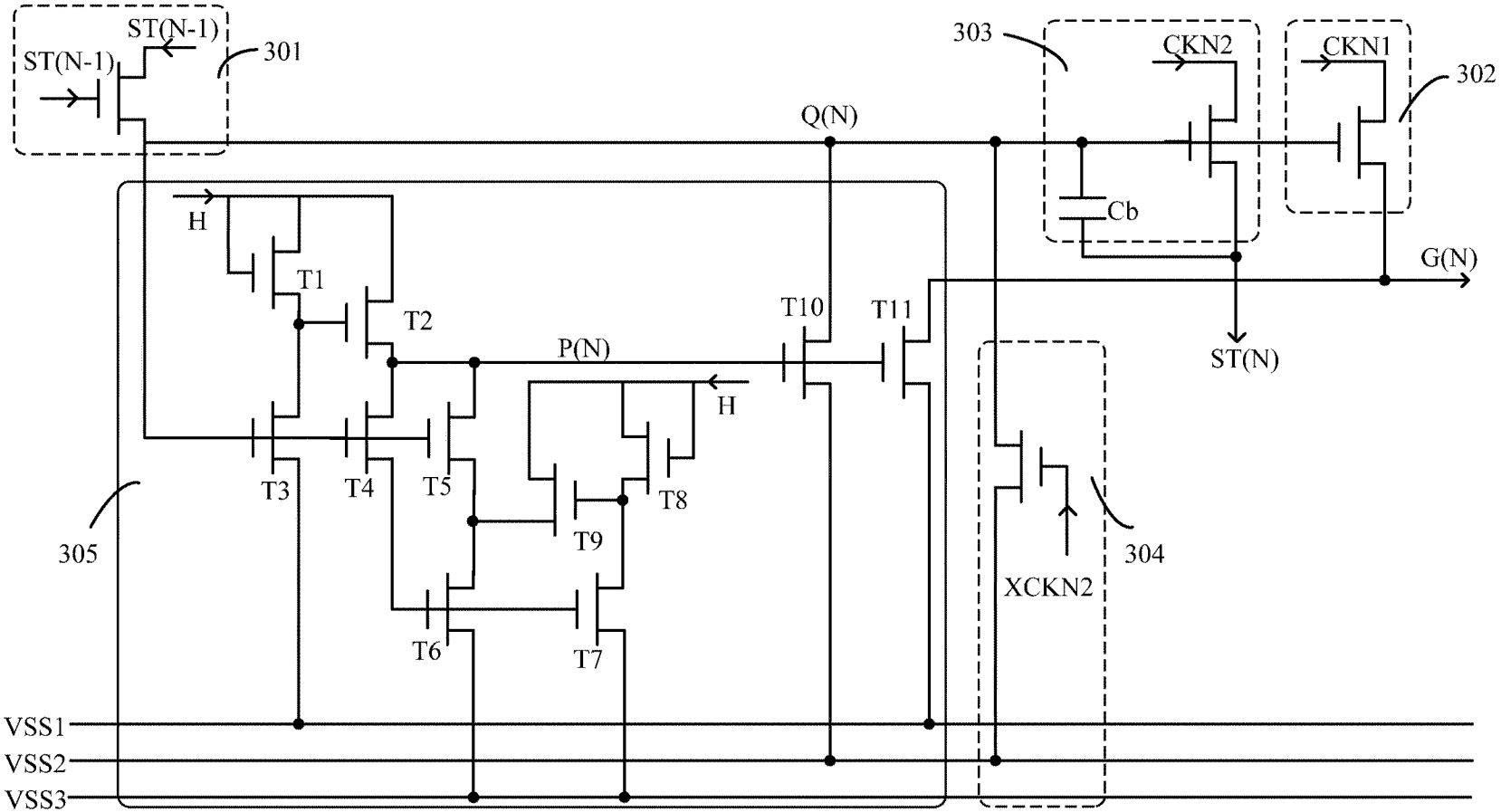
FIG. 3 is the schematic diagram illustrating the specific circuit connection of the GOA unit of the second embodiment of the GOA circuit according to the disclosure.

Refer to FIG. 3 for the schematic diagram illustrating the specific circuit connection of the GOA unit of the second embodiment of the GOA circuit according to the disclosure. The N-staged GOA units comprise N-staged pull-up control circuits 301, N-staged pull-up circuits 302, N-staged transfer circuits 303, N-staged pull-down circuits 304, and N-staged pull-down holding circuits 305. The N-staged pull-up circuits 302 and the N-staged pull-down holding circuits 305 connect to the Nth-staged gate signal point Q(N) and the Nth-staged horizontal scanning line G(N) respectively. The N-staged pull-up control circuits 301, the N-staged pull-down circuits 304, and the N-staged transfer circuits 303 connect to the Nth-staged gate signal point Q(N). The N-staged pull-up circuits 302 and the N-staged transfer circuits turn on when Q(N) is at a high voltage level, and respectively receive a first clock signal CKN1 and a second clock signal CKN2 and output the signals. The pulse width of the second clock signal CKN2 is greater than the pulse width of the first clock signal CKN1.

The N-staged pull-down holding circuits 305 comprise:

a first transistor T1 having a gate and a drain connected to a direct current high voltage H; a second transistor T2 having a gate connected to the source of the first transistor T1, a drain connected to the direct current high voltage H, and a source connected to a first common point P(N); a third transistor T3 having a gate connected to the Nth-staged gate signal point Q(N), a drain connected to the source of the first transistor T1, and a source connected to the first direct current low voltage VSS1; a fourth transistor T4 having a gate connected to the Nth-staged gate signal point Q(N) and a drain connected to the common point P(N); a fifth transistor T5 having a gate connected to the Nth-staged gate signal point Q(N) and a drain connected to the common point P(N); a sixth transistor T6 having a gate connected to the source of the fourth transistor T4, a drain connected to the source of the fifth transistor T5 and a source connected to the third direct current low voltage VSS3; a seventh transistor T7 having a gate connected to the source of the fourth transistor T4, and a source connected to the third direct current low voltage VSS3; an eighth transistor T8 having a gate and a drain connected to the direct current high voltage H; a ninth transistor T9 having a gate connected to the source of the eighth transistor T8, a drain connected to the direct current high voltage H and a source connected to the source of the fifth transistor T5; a tenth transistor T10 having a gate connected to the common point P(N), a drain connected to the Nth-staged gate signal point Q(N), and a source connected to the second direct current low voltage VSS2; and an eleventh transistor T11 having a gate connected to the common point P(N), a drain connected to the Nth-staged horizontal scanning line G(N) and a source connected to the second direct current low voltage VSS2. The first direct current low voltage VSS1 is grater than the second direct current low voltage VSS2, and the second direct current low voltage VSS2 is greater than the third direct current low voltage VSS3.

Figure 4:
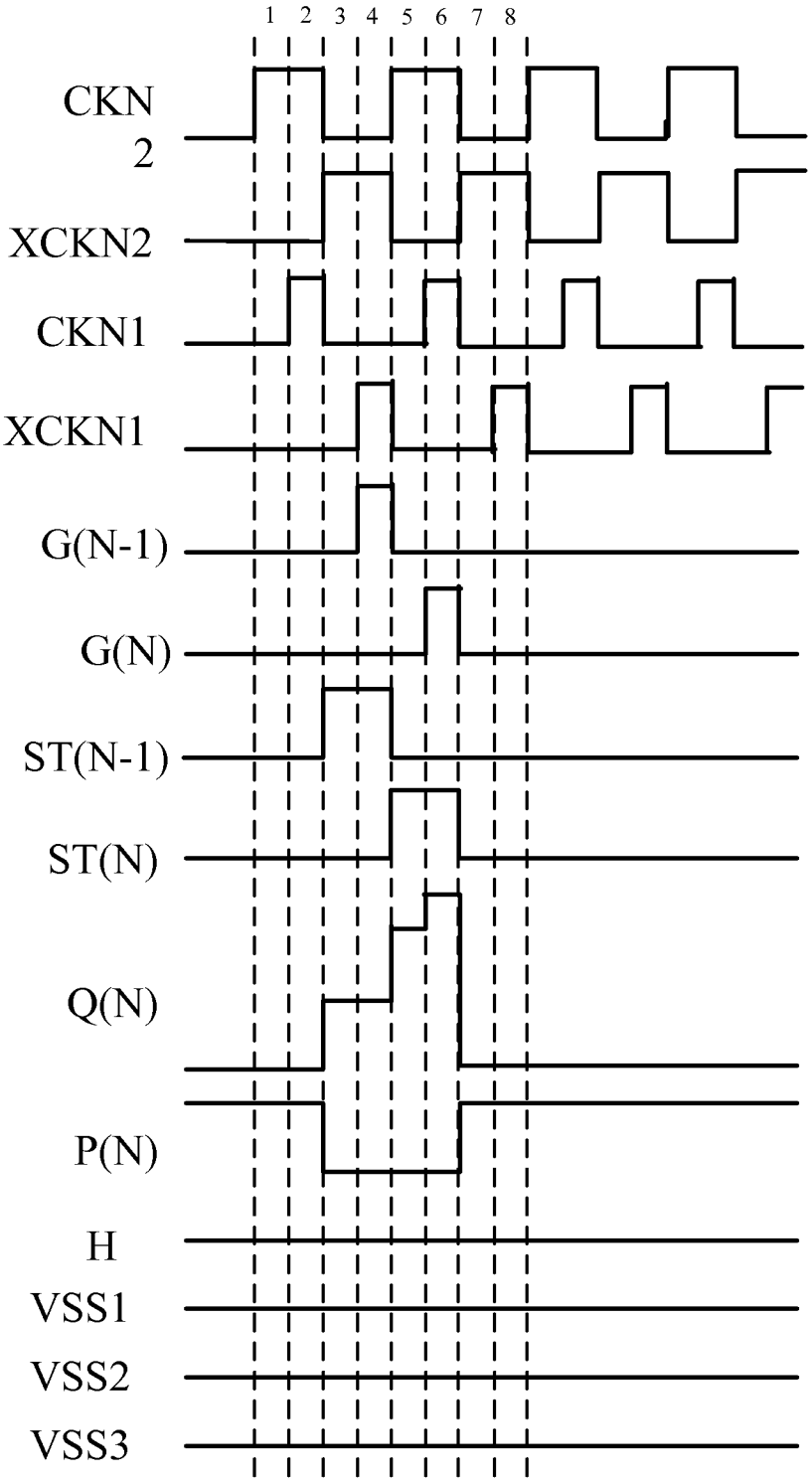
FIG. 4 is the schematic for the first voltage waveform diagram for each point in the GOA unit of the second embodiment of the GOA circuit according to the disclosure.

Refer to FIG. 4 for the schematic for the first voltage waveform diagram for each point in the GOA unit of the second embodiment of the GOA circuit according to the disclosure. In the waveform diagram, XCKN2 is input to the control terminals of the N-staged pull-down circuits. Two periods of the second clock signal CKN2 are taken for example to illustrate the operation principal.

In the operation section 1, because the transfer signal ST(N−1) of the former stage is at low voltage level, the Nth pull-up control circuit 301 and the N-staged transfer circuit turn off. T3, T4 and T5 also turn off at this time. However because T1 and T2 turn on and H signal is input, the common point P(N) is at the high voltage level such that T10 and T11 turn on to pull down the voltage level of the Nth-staged gate signal point Q(N) and the Nth-staged horizontal scanning line G(N) respectively.

In the operation section 2, only the first clock signal CKN1 changes, and other clock signals and the transfer signals do not change. However because the N-staged pull-up circuits turn off, the voltage levels of the other points do not have change.

In the operation section 3, the transfer signal ST(N−1) of the former stage is at high voltage level. The N-staged pull-up control circuits 301 turn on. The voltage level of the Nth-staged gate signal point Q(N) is raised. The common point P(N) is lowered to low voltage level. The N-staged pull-up circuits 302 and the N-staged transfer circuits turn on. G(N) and CKN1 are the same. ST(N) and CKN2 are the same.

In the operation section 4, because the bootstrap of the capacitor Cb, the Nth-staged gate signal point Q(N) continues to maintain at high voltage level. G(N) and CKN1 are the same. ST(N) and CKN2 are the same.

In the operation section 5, the second clock signal CKN2 changes to high voltage level and the N-staged transfer signals ST(N) of high voltage level are output. The voltage level of the Nth-staged gate signal point Q(N) is raised to a higher level through the capacitor Cb to ensure the free output for the N-staged pull-up circuits 302 and the transfer circuits 303.

In the operation section 6, the voltage level of the Nth-staged gate signal point Q(N) is raised to an even higher level. CKN1 changes to high voltage level. The Nth-staged horizontal scanning line G(N) outputs the signal of high voltage level successfully.

In the operation section 7, XCKN2 changes to high voltage level. The voltage level of the Nth-staged gate signal point Q(N) is pulled down. The N-staged pull-up circuits 302 and the Nth-stage transfer circuits 303 turn off. The Nth-staged horizontal scanning line G(N) and the transfer signal ST(N) are at low voltage level.

In the operation section 8, the voltage level of each point is similar to that in the operation section 7. Each output is maintained at the low voltage level.

In the above embodiment, the third clock signal XCNK2 is input to the control terminals of the N-staged pull-down circuits.

The duty ratio of the first clock signal CKN1 is less than 50%, and the starting time of the high voltage level of the first clock signal CKN1 is the same as the starting time of the high voltage level of the second clock signal CKN2; wherein the high voltage level of the third clock signal XCNK2 corresponds to the low voltage level of the second clock signal CKN2, and the low voltage level of the third clock signal XCNK2 corresponds to the high voltage level of the second clock signal CKN2.

Figure 5:
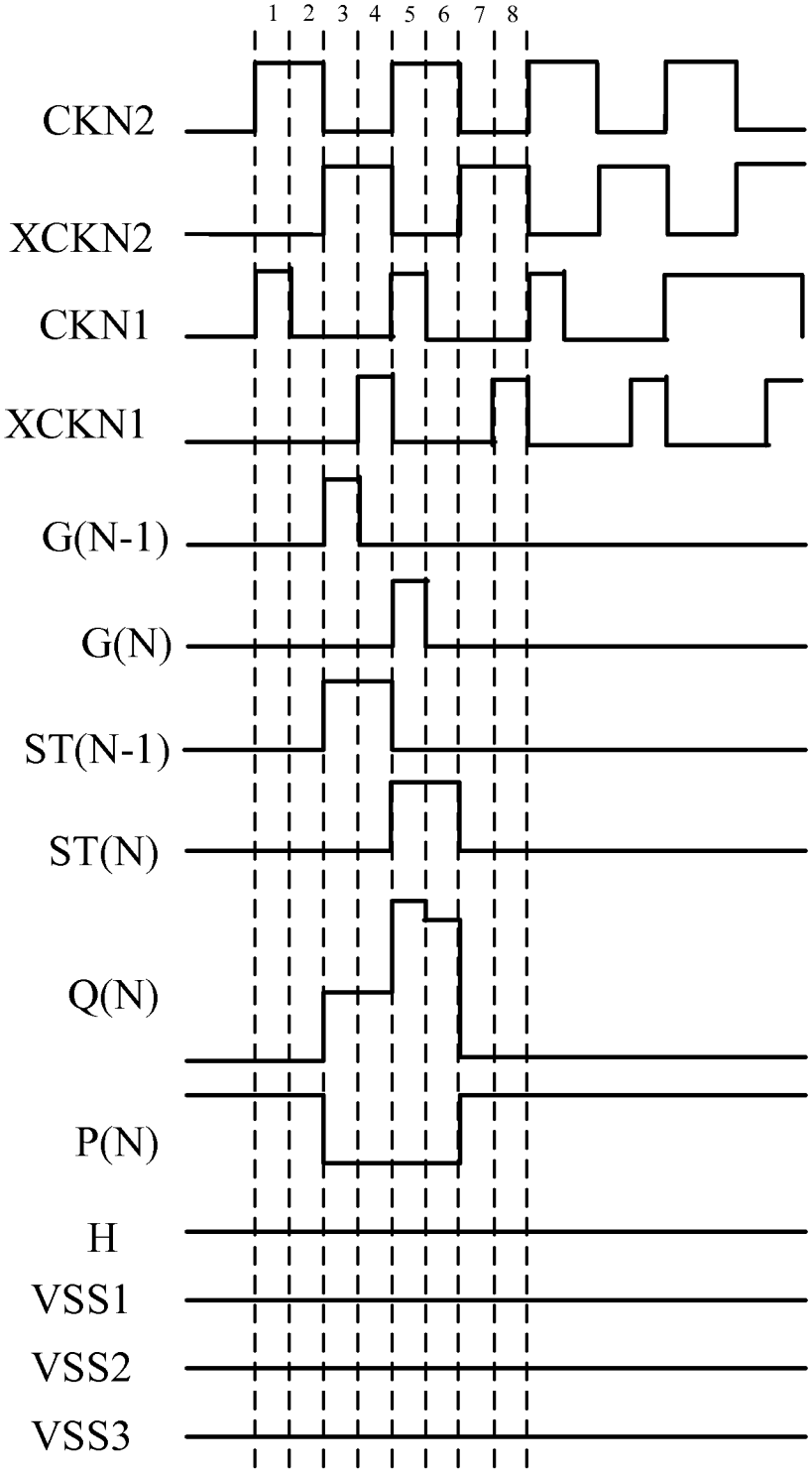
FIG. 5 is the schematic for the second voltage waveform diagram for each point in the GOA unit of the second embodiment of the GOA circuit according to the disclosure.

Refer to FIG. 5 for the schematic for the second voltage waveform diagram for each point in the GOA unit of the second embodiment of the GOA circuit according to the disclosure.

The second waveform is similar to the first waveform. The difference lies in that the phase of the first clock signal CKN1 is left-shifted for ¼ period such that the voltage level of the Nth-staged gate signal point Q(N) slightly decreases. The Nth-staged horizontal scanning line G(N) outputs signals in the operation section 5.

In the above embodiment, the third clock signal XCNK2 is input to the control terminals of the N-staged pull-down circuits. The duty ratio of the first clock signal is less than 50%, and the ending time of the high voltage level of the first clock signal CKN1 is the same as the ending time of the high voltage level of the second clock signal CKN2; wherein the high voltage level of the third clock signal XCNK2 corresponds to the low voltage level of the second clock signal CKN2, and the low voltage level of the third clock signal XCNK2 corresponds to the high voltage level of the second clock signal CKN2.

Certainly the starting time and the ending time of the high voltage level of the first clock signal CKN1 may not be the same as the starting time and the ending time of the high voltage level of the second clock signal CKN2. The interval of the high voltage level of the first clock signal CKN1 may be in the interval of the high voltage level of the second clock signal CKN2.

Figure 6:
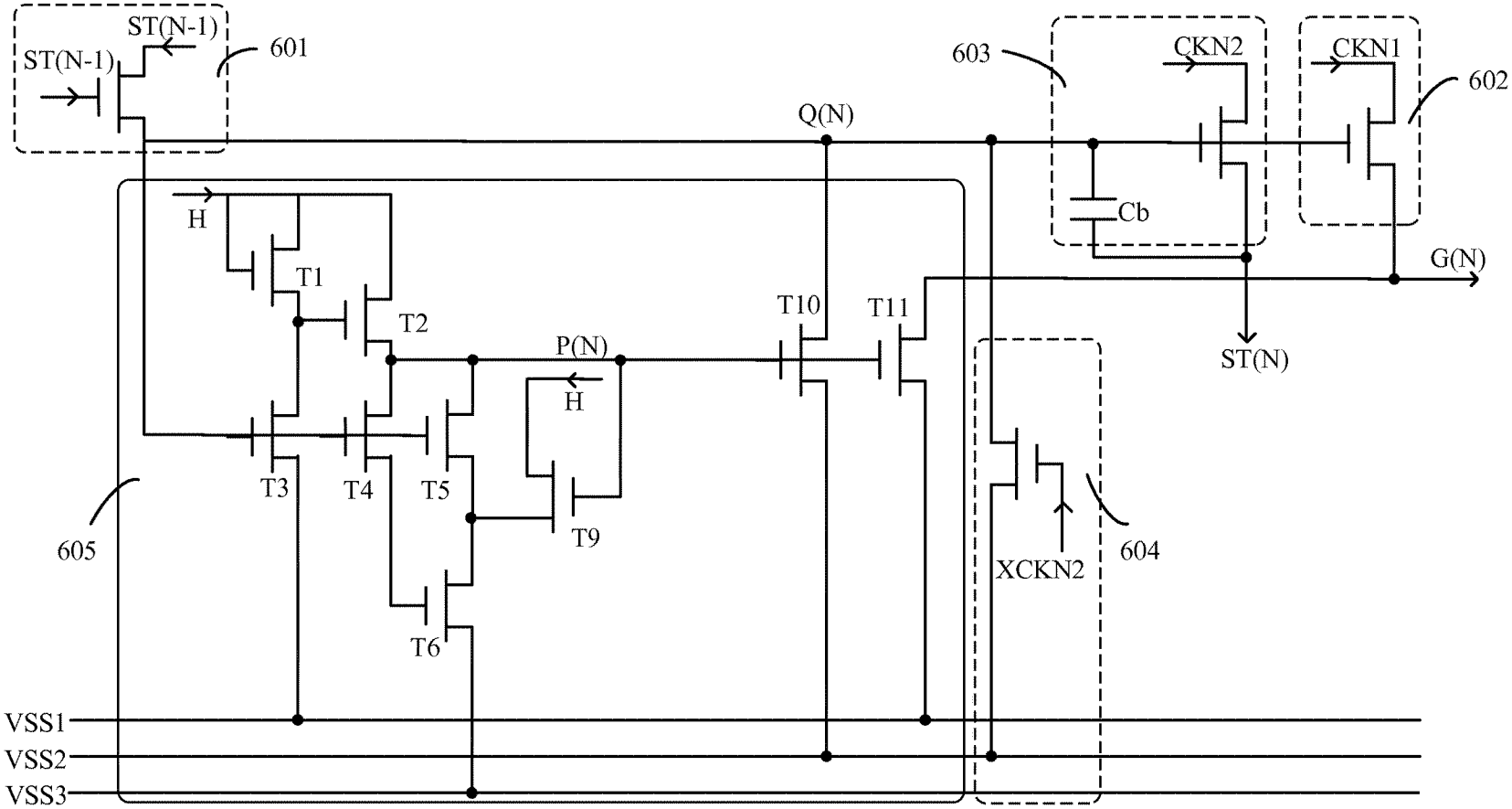
FIG. 6 is the schematic diagram illustrating the specific circuit connection of the GOA unit of the third embodiment of the GOA circuit according to the disclosure.

Refer to FIG. 6 for the schematic diagram illustrating the specific circuit connection of the GOA unit of the third embodiment of the GOA circuit according to the disclosure. The difference between this embodiment and the second embodiment lies in that the N-staged pull-down holding circuits 605 do not comprise the seventh transistor T7 and the eighth transistor T8. The gate of the ninth transistor T9 is connected to the common point P(N). The embodiment reduces two TFT transistors, and the circuit is simplified. The power consumption is reduced.

Figure 7:
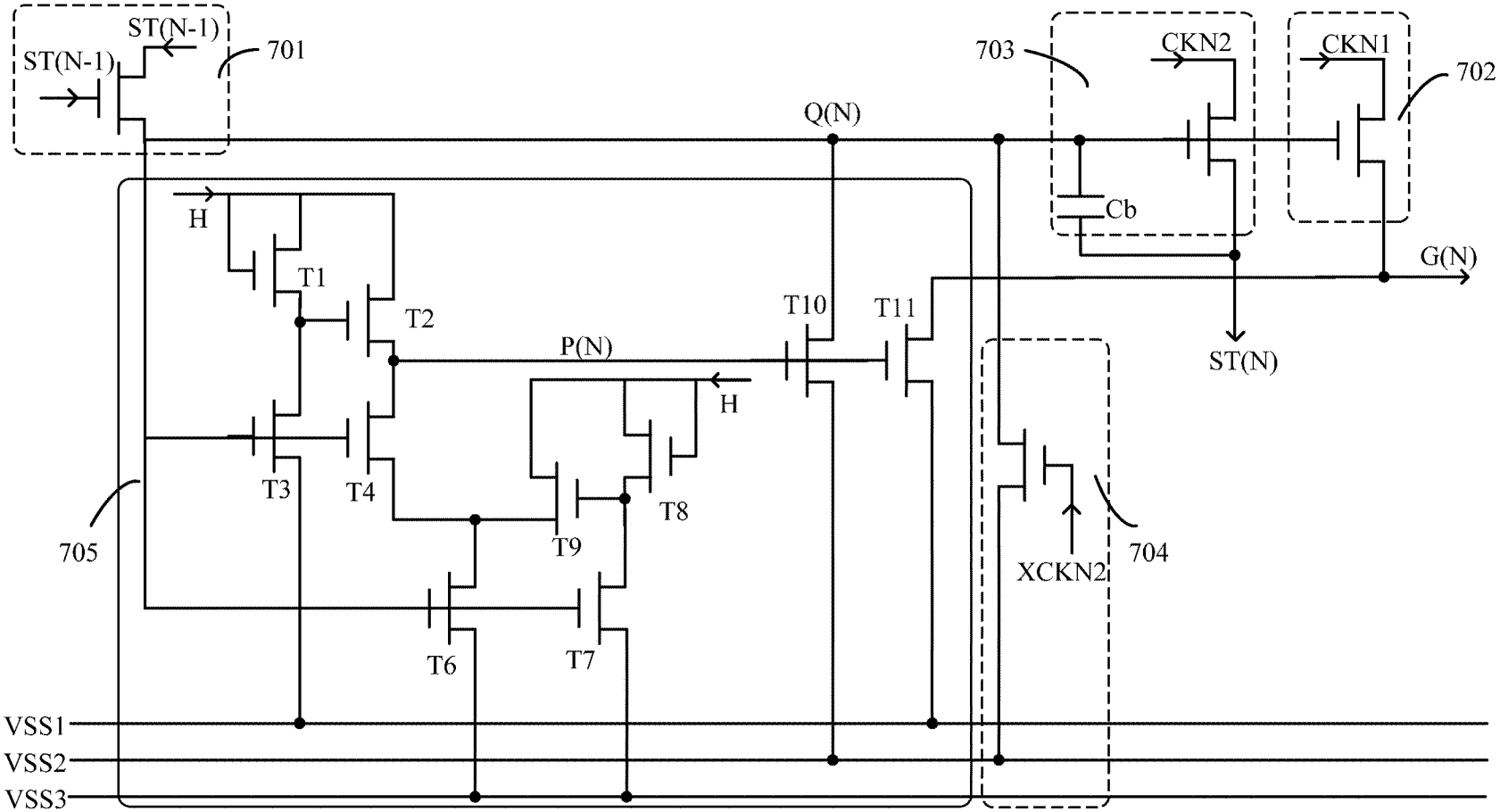
FIG. 7 is the schematic diagram illustrating the specific circuit connection of the GOA unit of the fourth embodiment of the GOA circuit according to the disclosure.

Refer to FIG. 7 for the schematic diagram illustrating the specific circuit connection of the GOA unit of the fourth embodiment of the GOA circuit according to the disclosure. The difference between this embodiment and the third embodiment lies in that the N-staged pull-down holding circuits 705 do not comprise the fifth transistor T5. The drain of the sixth transistor T6 and the source of the ninth transistor T9 are connected to the source of the fourth transistor T4, and the gate of the sixth transistor T6 and the gate of the seventh transistor T7 are connected to the Nth-staged gate signal point Q(N).

Figure 8:
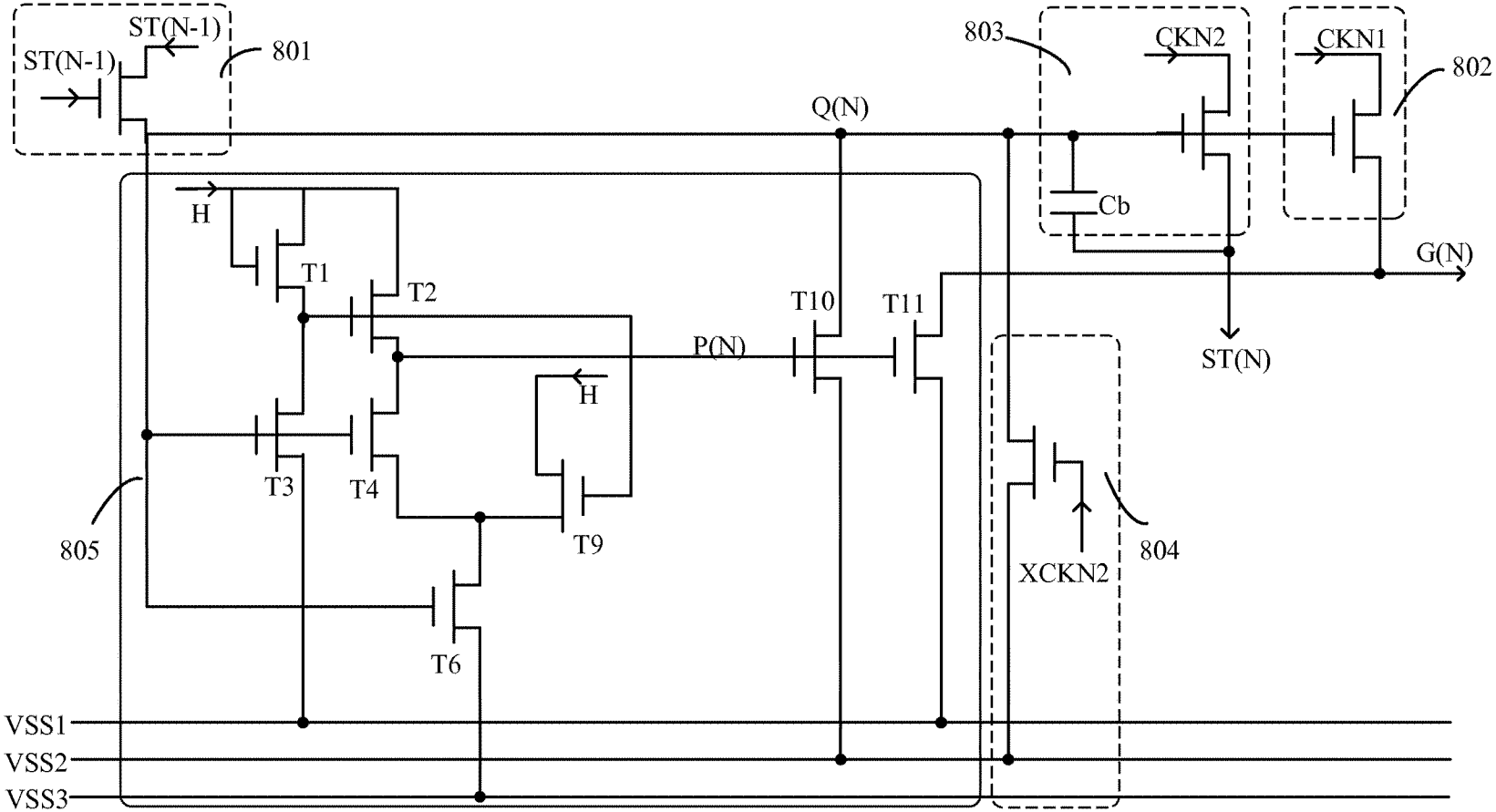
FIG. 8 is the schematic diagram illustrating the specific circuit connection of the GOA unit of the fifth embodiment of the GOA circuit according to the disclosure.

Refer to FIG. 8 for the schematic diagram illustrating the specific circuit connection of the GOA unit of the fifth embodiment of the GOA circuit according to the disclosure. The difference between this embodiment and the fourth embodiment lies in that the N-staged pull-down holding circuits 805 do not comprise the seventh transistor T7 and the eighth transistor T8. The gate of the ninth transistor T9 is connected to the gate of the second transistor T2. The embodiment adopts the existing circuitry key points as the signals to reduce the connection of the direct current high voltage signals H and thus the circuit is simplified.

Figure 9:
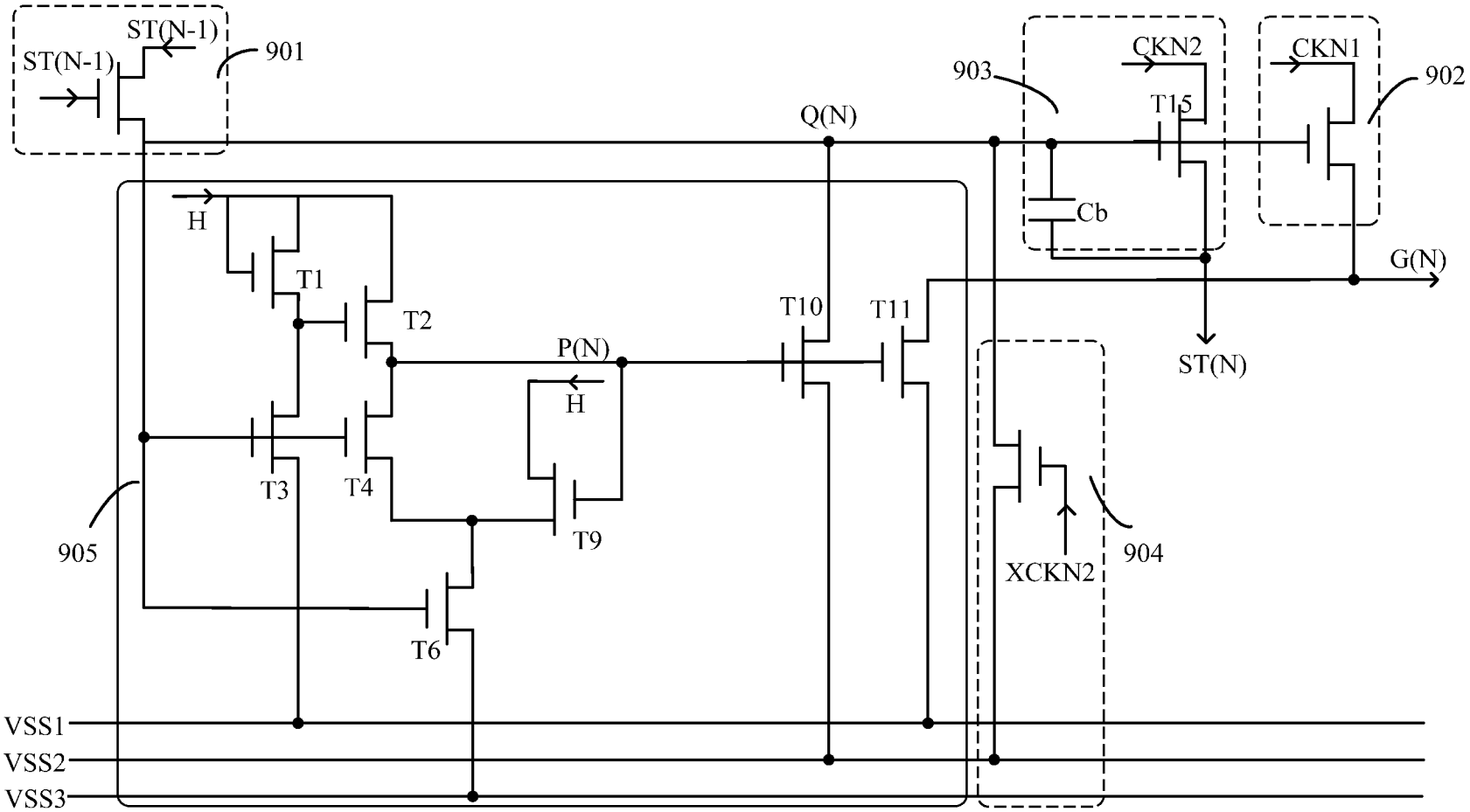
FIG. 9 is the schematic diagram illustrating the specific circuit connection of the GOA unit of the sixth embodiment of the GOA circuit according to the disclosure.

Refer to FIG. 9 for the schematic diagram illustrating the specific circuit connection of the GOA unit of the sixth embodiment of the GOA circuit according to the disclosure. This embodiment is a variation of the fifth embodiment. The principle is similar.

In the various embodiments mentioned above, the bootstrap capacitor Cb in the N-staged transfer circuits may be removed.

In a first embodiment of the liquid crystal display of the disclosure, the liquid crystal display comprises the GOA circuits of the various embodiments mentioned above.

Although the present disclosure is illustrated and described with reference to specific embodiments, those skilled in the art will understand that many variations and modifications are readily attainable without departing from the spirit and scope thereof as defined by the appended claims and their legal equivalents.

What is claimed is:

1. A GOA circuit for a liquid crystal display, the GOA circuit comprising a plurality of GOA units, the N-staged GOA units charging the Nth-staged horizontal scanning line in the display region, the N-staged GOA units comprising N-staged pull-up control circuits, N-staged pull-up circuits, N-staged transfer circuits, N-staged pull-down circuits, and N-staged pull-down holding circuits;

wherein the N-staged pull-up circuits and the N-staged pull-down holding circuits connect to the Nth-staged gate signal point and the Nth-staged horizontal scanning line respectively, the N-staged pull-up control circuits, the N-staged pull-down circuits, and the N-staged transfer circuits connect to the Nth-staged gate signal point;

wherein the N-staged pull-up circuits turn on when the Nth-staged gate signal point is at a high voltage level, receive a first clock signal and charge the N-staged horizontal scanning lines when the first clock signal is at a high voltage level;

wherein the N-staged transfer circuits receive a second clock signal when the Nth-staged gate signal point is at the high voltage level and output N-staged transfer signals to control the operation of the (N+1)-staged GOA units;

wherein the pulse width of the second clock signal is greater than the pulse width of the first clock signal;

wherein the N-staged pull-down holding circuits comprise:

a first transistor having a gate and a drain connected to a direct current high voltage;

a second transistor having a gate connected to the source of the first transistor, a drain connected to the direct current high voltage, and a source connected to a first common point;

a third transistor having a gate connected to the Nth-staged gate signal point, a drain connected to the source of the first transistor, and a source connected to the first direct current low voltage;

a fourth transistor having a gate connected to the Nth-staged gate signal point and a drain connected to the common point;

a fifth transistor having a gate connected to the Nth-staged gate signal point and a drain connected to the common point;

a sixth transistor having a gate connected to the source of the fourth transistor, a drain connected to the source of the fifth transistor and a source connected to the third direct current low voltage;

a seventh transistor having a gate connected to the source of the fourth transistor, and a source connected to the third direct current low voltage;

an eighth transistor having a gate and a drain connected to the direct current high voltage;

a ninth transistor having a gate connected to the source of the eighth transistor, a drain connected to the direct current high voltage and a source connected to the source of the fifth transistor;

a tenth transistor having a gate connected to the common point, a drain connected to the Nth-staged gate signal point, and a source connected to the second direct current low voltage; and an eleventh transistor having a gate connected to the common point, a drain connected to the Nth-staged horizontal scanning line and a source connected to the second direct current low voltage;

wherein the first direct current low voltage is grater than the second direct current low voltage, and the second direct current low voltage is greater than the third direct current low voltage;

wherein the N-staged transfer circuits comprise N-staged bootstrap capacitors;

wherein the N-staged bootstrap capacitors are connected between the Nth-staged gate signal points and the Nth-staged horizontal scanning line.

2. The GOA circuit according to claim 1, wherein the N-staged pull-down holding circuits comprises the first transistor, the second transistor, the third transistor, the fourth transistor, the fifth transistor, the sixth transistor, the ninth transistor, the tenth transistor, and the eleventh transistor; wherein the gate of the ninth transistor is connected to the common point.

3. The GOA circuit according to claim 2, wherein the N-staged pull-down holding circuits comprises the first transistor, the second transistor, the third transistor, the fourth transistor, the sixth transistor, the seventh transistor, the eighth transistor, the ninth transistor, the tenth transistor, and the eleventh transistor; wherein the drain of the sixth transistor and the source of the ninth transistor are connected to the source of the fourth transistor, and the gate of the sixth transistor and the gate of the seventh transistor are connected to the Nth-staged gate signal point.

4. The GOA circuit according to claim 3, wherein the N-staged pull-down holding circuits comprises the first transistor, the second transistor, the third transistor, the fourth transistor, the sixth transistor, the ninth transistor, the tenth transistor, and the eleventh transistor; wherein the gate of the ninth transistor is connected to the gate of the second transistor.

5. The GOA circuit according to claim 4, wherein the gate of the ninth transistor is connected to the common point.

6. The GOA circuit according to claim 5, wherein the control terminals of the N-staged pull-down circuits are input with a third clock signal; wherein the duty ratio of the first clock signal is less than 50%, and the starting time of the high voltage level of the first clock signal is the same as the starting time of the high voltage level of the second clock signal; wherein the high voltage level of the third clock signal corresponds to the low voltage level of the second clock signal, and the low voltage level of the third clock signal corresponds to the high voltage level of the second clock signal.

7. The GOA circuit according to claim 5, wherein the control terminals of the N-staged pull-down circuits are input with the third clock signal; wherein the duty ratio of the first clock signal is less than 50%, and the ending time of the high voltage level of the first clock signal is the same as the ending time of the high voltage level of the second clock signal; wherein the high voltage level of the third clock signal corresponds to the low voltage level of the second clock signal, and the low voltage level of the third clock signal corresponds to the high voltage level of the second clock signal.

8. A GOA circuit for a liquid crystal display, the GOA circuit comprising a plurality of GOA units, the N-staged GOA units charging the Nth-staged horizontal scanning line in the display region, the N-staged GOA units comprising N-staged pull-up control circuits, N-staged pull-up circuits, N-staged transfer circuits, N-staged pull-down circuits, and N-staged pull-down holding circuits;

wherein the N-staged pull-up circuits and the N-staged pull-down holding circuits connect to the Nth-staged gate signal point and the Nth-staged horizontal scanning line respectively, the N-staged pull-up control circuits, the N-staged pull-down circuits, and the N-staged transfer circuits connect to the Nth-staged gate signal point;

wherein the N-staged pull-up circuits turn on when the Nth-staged gate signal point is at a high voltage level, receive a first clock signal and charge the N-staged horizontal scanning lines when the first clock signal is at a high voltage level;

wherein the N-staged transfer circuits receive a second clock signal when the Nth-staged gate signal point is at the high voltage level and output N-staged transfer signals to control the operation of the (N+1)-staged GOA units;

wherein the pulse width of the second clock signal is greater than the pulse width of the first clock signal.

9. The GOA circuit according to claim 8, wherein the N-staged pull-down holding circuits comprise:

a first transistor having a gate and a drain connected to a direct current high voltage;

a second transistor having a gate connected to the source of the first transistor, a drain connected to the direct current high voltage, and a source connected to a first common point;

a third transistor having a gate connected to the Nth-staged gate signal point, a drain connected to the source of the first transistor, and a source connected to the first direct current low voltage;

a fourth transistor having a gate connected to the Nth-staged gate signal point and a drain connected to the common point;

a fifth transistor having a gate connected to the Nth-staged gate signal point and a drain connected to the common point;

a sixth transistor having a gate connected to the source of the fourth transistor, a drain connected to the source of the fifth transistor and a source connected to the third direct current low voltage;

a seventh transistor having a gate connected to the source of the fourth transistor, and a source connected to the third direct current low voltage;

an eighth transistor having a gate and a drain connected to the direct current high voltage;

a ninth transistor having a gate connected to the source of the eighth transistor, a drain connected to the direct current high voltage and a source connected to the source of the fifth transistor;

a tenth transistor having a gate connected to the common point, a drain connected to the Nth-staged gate signal point, and a source connected to the second direct current low voltage; and an eleventh transistor having a gate connected to the common point, a drain connected to the Nth-staged horizontal scanning line and a source connected to the second direct current low voltage;

wherein the first direct current low voltage is grater than the second direct current low voltage, and the second direct current low voltage is greater than the third direct current low voltage.

10. The GOA circuit according to claim 9, wherein the N-staged pull-down holding circuits comprises the first transistor, the second transistor, the third transistor, the fourth transistor, the fifth transistor, the sixth transistor, the ninth transistor, the tenth transistor, and the eleventh transistor; wherein the gate of the ninth transistor is connected to the common point.

11. The GOA circuit according to claim 10, wherein the N-staged pull-down holding circuits comprises the first transistor, the second transistor, the third transistor, the fourth transistor, the sixth transistor, the seventh transistor, the eighth transistor, the ninth transistor, the tenth transistor, and the eleventh transistor; wherein the drain of the sixth transistor and the source of the ninth transistor are connected to the source of the fourth transistor, and the gate of the sixth transistor and the gate of the seventh transistor are connected to the Nth-staged gate signal point.

12. The GOA circuit according to claim 11, wherein the N-staged pull-down holding circuits comprises the first transistor, the second transistor, the third transistor, the fourth transistor, the sixth transistor, the ninth transistor, the tenth transistor, and the eleventh transistor; wherein the gate of the ninth transistor is connected to the gate of the second transistor.

13. The GOA circuit according to claim 12, wherein the gate of the ninth transistor is connected to the common point.

14. The GOA circuit according to claim 12, wherein the control terminals of the N-staged pull-down circuits are input with a third clock signal; wherein the duty ratio of the first clock signal is less than 50%, and the starting time of the high voltage level of the first clock signal is the same as the starting time of the high voltage level of the second clock signal; wherein the high voltage level of the third clock signal corresponds to the low voltage level of the second clock signal, and the low voltage level of the third clock signal corresponds to the high voltage level of the second clock signal.

15. The GOA circuit according to claim 12, wherein the control terminals of the N-staged pull-down circuits are input with the third clock signal; wherein the duty ratio of the first clock signal is less than 50%, and the ending time of the high voltage level of the first clock signal is the same as the ending time of the high voltage level of the second clock signal; wherein the high voltage level of the third clock signal corresponds to the low voltage level of the second clock signal, and the low voltage level of the third clock signal corresponds to the high voltage level of the second clock signal.

16. The GOA circuit according to claim 8, wherein the N-staged transfer circuits comprise N-staged bootstrap capacitors, wherein the N-staged bootstrap capacitors are connected between the Nth-staged gate signal points and the Nth-staged horizontal scanning line.

17. A liquid crystal display comprising a GOA circuit, the GOA circuit comprising a plurality of GOA units, the N-staged GOA units charging the Nth-staged horizontal scanning line in the display region, the N-staged GOA units comprising N-staged pull-up control circuits, N-staged pull-up circuits, N-staged transfer circuits, N-staged pull-down circuits, and N-staged pull-down holding circuits;

wherein the N-staged pull-up circuits and the N-staged pull-down holding circuits connect to the Nth-staged gate signal point and the Nth-staged horizontal scanning line respectively, the N-staged pull-up control circuits, the N-staged pull-down circuits, and the N-staged transfer circuits connect to the Nth-staged gate signal point;

wherein the N-staged pull-up circuits turn on when the Nth-staged gate signal point is at a high voltage level, receive a first clock signal and charge the N-staged horizontal scanning lines when the first clock signal is at a high voltage level;

wherein the N-staged transfer circuits receive a second clock signal when the Nth-staged gate signal point is at the high voltage level and output N-staged transfer signals to control the operation of the (N+1)-staged GOA units;

wherein the pulse width of the second clock signal is greater than the pulse width of the first clock signal.

18. The liquid crystal display according to claim 17, wherein the N-staged pull-down holding circuits comprise:

a first transistor having a gate and a drain connected to a direct current high voltage;

a second transistor having a gate connected to the source of the first transistor, a drain connected to the direct current high voltage, and a source connected to a first common point;

a third transistor having a gate connected to the Nth-staged gate signal point, a drain connected to the source of the first transistor, and a source connected to the first direct current low voltage;

a fourth transistor having a gate connected to the Nth-staged gate signal point and a drain connected to the common point;

a fifth transistor having a gate connected to the Nth-staged gate signal point and a drain connected to the common point;

a sixth transistor having a gate connected to the source of the fourth transistor, a drain connected to the source of the fifth transistor and a source connected to the third direct current low voltage;

a seventh transistor having a gate connected to the source of the fourth transistor, and a source connected to the third direct current low voltage;

an eighth transistor having a gate and a drain connected to the direct current high voltage;

a ninth transistor having a gate connected to the source of the eighth transistor, a drain connected to the direct current high voltage and a source connected to the source of the fifth transistor;

a tenth transistor having a gate connected to the common point, a drain connected to the Nth-staged gate signal point, and a source connected to the second direct current low voltage; and an eleventh transistor having a gate connected to the common point, a drain connected to the Nth-staged horizontal scanning line and a source connected to the second direct current low voltage;

wherein the first direct current low voltage is grater than the second direct current low voltage, and the second direct current low voltage is greater than the third direct current low voltage.

* * * * *